United States Patent [19]

Niggemeyer

[11] Patent Number: 4,696,280

[45] Date of Patent: Sep. 29, 1987

[54] HIGH-TENSION CAPACITOR-DISCHARGE IGNITION APPARATUS FOR INTERNAL COMBUSTION ENGINES

[76] Inventor: Gert G. Niggemeyer, Steinbecker Mühlenweg 95, D-2110 Buchholz, Fed. Rep. of Germany

[21] Appl. No.: 893,408

[22] Filed: Aug. 5, 1986

[30] Foreign Application Priority Data

Oct. 3, 1985 [DE] Fed. Rep. of Germany ..... 3535365

[51] Int. Cl.[4] ..... F02P 3/08

[52] U.S. Cl. ..... 123/598; 123/605; 123/656

[58] Field of Search ..... 123/596, 597, 598, 604, 123/605, 606, 637, 645, 646, 655, 656

[56] References Cited

U.S. PATENT DOCUMENTS

| | | | |
|---|---|---|---|
| 3,517,260 | 6/1970 | Oishi | 123/598 X |
| 3,677,253 | 7/1972 | Oishi et al. | 123/598 |
| 3,838,328 | 9/1974 | Lundy | 123/598 X |
| 4,069,801 | 1/1978 | Stevens | 123/598 |
| 4,502,454 | 3/1985 | Hamai et al. | 123/598 X |

FOREIGN PATENT DOCUMENTS

| | | | |
|---|---|---|---|
| 58-159 | 4/1984 | Japan | 123/598 |

*Primary Examiner*—Tony M. Argenbright

*Attorney, Agent, or Firm*—Cohen, Pontani & Lieberman

[57] ABSTRACT

A high-tension Capacitor Discharge Ignition apparatus for internal combustion engines is supplied with battery low voltage and generates high voltage utilizing a push-pull amplifier controlled by a pulse-width modulator operating in the audio frequency range and with a thyristor. A capacitor is charged from the high voltage and is triggered by the thyristor to discharge its stored potential through the primary windings of an ignition coil, the thyristor being triggered at its gate by engine ignition pulses blocked by switching-off of the high voltage power source. The voltage present at the thyristor gate is continually applied to at least one comparator and serves as an information source for the thyristor's operating condition. The comparator, based upon its comparison of the thyristor gate voltage with a predetermined reference voltage, generates a signal for deactivating the high voltage source so long as the thyristor remains in its conductive condition. A diode arranged in series connection with a parallel choke and resistor shunts the primary windings of the ignition coil.

14 Claims, 5 Drawing Figures

HIGH-TENSION CAPACITOR-DISCHARGE IGNITION APPARATUS FOR INTERNAL COMBUSTION ENGINES

FIELD OF THE INVENTION

This invention relates to a high tension Capacitor Discharge Ignition System apparatus.

BACKGROUND OF THE INVENTION

A heretofore known capacitor-discharge ignition system apparatus is, for example, disclosed on page 83 of the book "Modern Electronic Circuits Reference Manual", McGraw-Hill Book Company, 1980. This known ignition system uses a switchable DC-DC converter formed of NAND-gates and running at a frequency of 10 kHz. Placed in series with a capacitor discharging thyristor is the primary winding of a transformer whose secondary winding triggers another thyristor to generate a pulse for blocking operation of the DC-DC converter. The duration of this blocking-pulse must be sufficiently long to delay restart of the converter while the main thyristor remains conductive, i.e. ionized. If the converter is restarted too soon, the thyristor will immediately conduct current again without being triggered at its gate-electrode by an ignition pulse. In addition, the selected blocking period for the converter must be sufficiently long to avoid a restart of the firing-capacitor recharging converter before the thyristor is completely de-ionized, i.e. in its non-conductive state, having discharged a maximum possible voltage joined with a maximum possible current through the thyristor.

In this prior art arrangement, the maximum ignition frequency is limited so as to generate sufficient high voltage for the firing-capacitor. Indeed, the period of blocking the converter of this known apparatus is varied in relation to the ignition frequency, further reducing the blocking period of the converter with increasing frequency. This is accomplished by placement of the transformer in the current path of the main thyristor which, after a pulse has been triggered, triggers the second thyristor to provide a blocking pulse, delayed by an R-C combination, to the NAND-gates. Although the blocking period decreases with increasing frequency, its proper length can only be approximated with respect to the actual condition of the thyristor; the blocking period must always be larger, and include a safety margin, than the physical absolute possible minimum period. As the transformer can transmit only current changes, a falsely triggered thyristor cannot be reverted from its permanent conductive condition unless and until the holding current is interrupted by switching off of the power source.

Moreover, the discharge time of the firing capacitor is primarily influenced by the impedance of the ignition coil. In the published prior art schematic, unless the blocking period is selected with regard to the largest possible impedance of an eventually-employed ignition coil, the apparatus must be optimized to the particular ignition coil to be used and production tolerances of the coil must be taken into consideration. If in addition the spark power is altered through variations in apparatus component values, the blocking-period must again be timed by R-C adjustment.

OBJECTS OF THE INVENTION

It is a accordingly an object of the invention to provide an improved capacitor-discharge ignition apparatus in which the electrical power source is always switched off only so long as the thyristor, under continually altering operating conditions, is in its conductive or ionized condition.

It is a further object of the invention to provide such an apparatus wherein the blocking period during which the power source is turned off is minimized.

It is another object to provide such an apparatus wherein the blocking period is continually self-adjusting so that neither changes of performance-influencing components of the apparatus or the external ignition installation influence the optimal blocking period of the electrical power source.

SUMMARY OF THE INVENTION

In an ignition system apparatus in accordance with the invention, the voltage present at the gate electrode of a thyristor is continuously monitored and compared with a reference voltage by means of at least one comparator.

The invention takes advantage of the cognition that the voltage occurring at the gate electrode provides continuous information concerning the instantaneous operating condition of the thyristor. That is, the voltage at the thyristor gate electrode has always reached its constant rest voltage of about $<1$ mV if the thyristor is de-ionized, i.e. completely blocked. In that condition, the thyristor can only be switched to a conductive condition if triggered at its gate electrode by a sufficiently large pulse. By utilizing at least one comparator, a signal can be generated to switch off the power source only so long, but always as long, as the thyristor is in its conductive i.e. ionized, condition. Thus the electrical power source is always switched off only as long as is absolutely mandatory for physical reasons. These shortest possible switching-off periods of the power source extend the usable charging periods for the firing-capacitor and thereby realize higher ignition frequencies with respectively increasing ignition voltage ($U_C$) in the upper range of engine revolutions. Furthermore, the switching-off period is optimally self-adjusting to component changes, such as alteration of the ignition coil impedance and an accompanying alteration of the spark burning period.

Moreover, through its continuous real time monitoring of the thyristor gate-electrode, the ignition system apparatus of the invention is extremely insensitive to malfunction so that, where a conductive or ionized condition of the thyristor is initiated by a failure—i.e. not caused by a triggering pulse given to the gate electrode—the condition is nevertheless detected. A mistakenly conductive, and by this power source shorting thyristor, can produce approximately 600 millivolts at its gate electrode; yet even under these conditions the comparator output signal will switch off the electrical power source, whereby the holding current of the thyristor is interrupted and therefore blocked.

By further development of series circuitry shunting the primary winding of the ignition coil, said circuitry consisting for example of a diode and a resistor with a choke in parallel, blocking of the thyristor can be accelerated. This accelerated blocking is accomplished by deriving a small pulse from the positively-polarized flyback pulse which is generated by the ignition coil, the derived pulse in turn charging the firing capacitor with altered polarity. After the decay of this small pulse the firing capacitor is connected with reversed polarity to the thyristor's anode-cathode path causing the accelerated deionization, i.e. blocking, of the thyristor. The main portion of the flyback pulse is, however, returned to the ignition coil across the diode and the very low DC-resistance of the choke and the parallel resistance connected thereto. Despite the withdrawal of a portion of the energy from the flyback pulse, the ignition spark can burn on without interruption as a direct current spark.

Further objects, features and advantages of the present invention will be more fully appreciated by reference to the following detailed description of a presently preferred, but nonetheless illustrative, embodiment in accordance with the present invention when taken in conjunction with the accompanying drawing.

BRIEF DESCRIPTION OF THE DRAWING

In the drawing, wherein similar reference characters denote similar elements throughout the several views.

DETAILED DESCRIPTION OF THE PREFERRED EMBODIMENT

Figure 1:
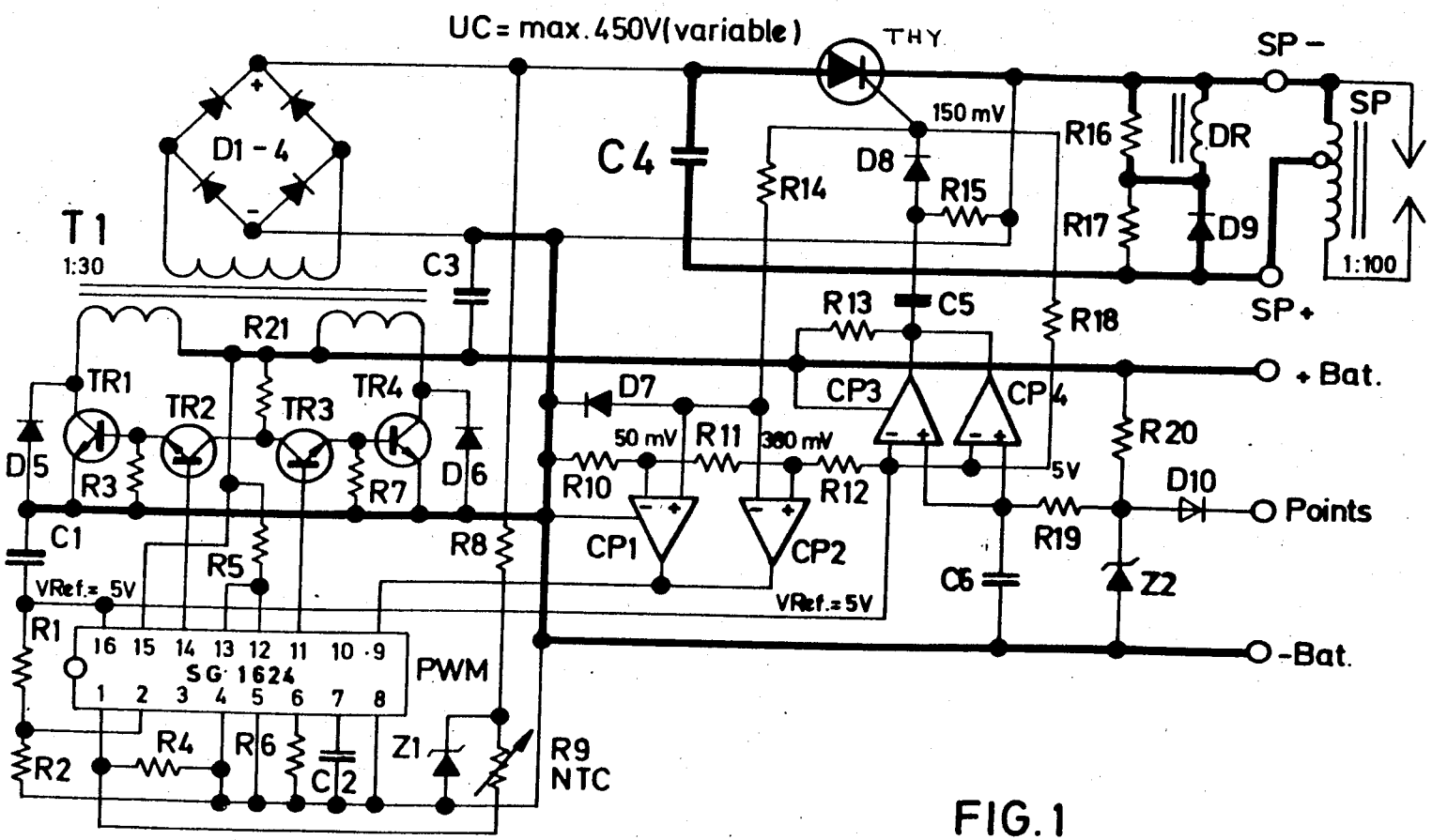
FIG. 1 is a schematic diagram of a preferred embodiment of a capacitor-discharge ignition system apparatus in accordance with the invention.

As should be apparent in the schematic diagram of FIG. 1, the electric power source is operating as an audio frequency push-pull blocking oscillator, at a frequency of approximately 10 kHz, and includes two power transistors TR1, TR4 and two driving transistors TR2, TR3. These transistors are connected in a known manner with resistors R3, R7, R21 and diodes D5 and D6 and to the primary windings of a transformer T1, the secondary winding of which is loaded by a bridge rectifier formed of diodes D1, D2, D3, D4. The blocking converter is controlled by a pulse width modulator PWM which may be implemented using a commercial integrated circuit. The modulator PWM provides a 5 volt reference voltage at its pin 16, which is then divided down to 2.5 Volts by resistors R1, R2 to yield a reference voltage to the comparator-connection pin 2 of the integrated circuit. The other comparator-connection pin 1 is connected to another voltage, divided down from the bridge-output DC high voltage $U_C$ and resistors R8, R9 and R4. A Zener diode is connected in parallel with resistor R9 to act as a thermistor and a negative temperature coefficient (NTC) resistance. Capacitors C1, C2 and C3 complete the electrical power source shown in the schematic diagram of FIG. 1.

The high tension voltage from the bridge-connected rectifier is applied to the firing-capacitor C4, which is connected in series with the ignition coil SP and to ground (i.e. the minus pole of the battery) along a thin-outlined connection in FIG. 1. The other end of firing-capacitor C4 is connected through a thyristor THY to ignition coil SP. A series circuit consisting of a diode D9 and a choke DR connected in parallel with a resistor R16 shunts the ignition coil SP. Diode D9, itself shunted by a resistor R17, is connected against the discharge direction of the firing capacitor C4.

An apparatus input, connectable to conventional ignition breaker points or to a different ignition-pulse generator, is wired through a diode D10 and a resistor R19 to one of the two inputs of each of a pair of comparators CP3 and CP4, to the remaining inputs of which is applied the 5 volt reference voltage derived from pin 16 of the modulator PWM circuit chip. The two ends of resistor R19 are also connected to ground, by way of the negative battery pole, through a capacitor C6 and a Zener diode Z2, respectively. A resistor R20 loads the breaker points with working current, and the Zener diode Z2 clips the incoming ignition pulses to a constant amplitude. The outputs of comparators CP3 and CP4 are connected together and then through a capacitor C5 and a diode D8 to the gate electrode of the thyristor THY. Capacitor C5 is also DC-coupled at its opposite ends by resistors R13 and R15. A biasing resistor R18 applies a part of the 5 volt reference voltage to the gate electrode of thyristor THY, thereby biasing it and minimally increasing its DC rest potential to, for example, 150 mV. It must be emphasized, however, that said biasing of the gate voltage, which occurs when the thyristor is blocked and which normally characteristically measures within the range of less than 1 mV to preferably 150 mV, does not affect the normal operating behavior of the thyristor.

The thyristor gate electrode is connected through a resistor R14 with one input of each of a second pair of comparators CP1, CP2 to thus apply to the comparators the actual voltage present at the gate electrode. The second inputs of comparators CP1, CP2 receive reference voltages of 50 mV and 380 mV, respectively. These reference voltages are derived from the 5 volt reference voltage by a voltage divider chain formed of resistors R10, R11 and R12. A diode D7 connected between inputs of comparators CP1, CP2 and ground provides overvoltage protection thereto. The tied-together outputs of comparators CP1, CP2 are connected to the compensation-input pin 9 of the pulse width modulator PWM, which is preferredly used in this application to switch off the modulator.

Operation of the FIG. 1 Apparatus

Figure 2:
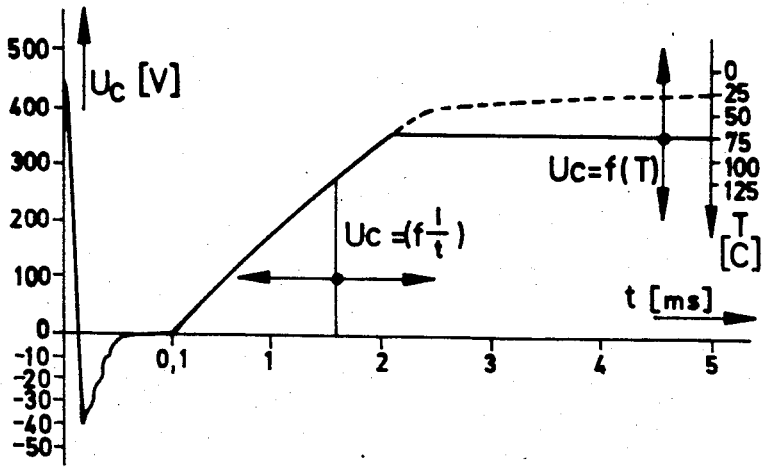
FIG. 2 is a graph of the voltage present at the firing capacitor.

If the thyristor THY is blocked and the voltage source switched on, a high tension of as much as 450 volts is generated at the outputs of the full wave rectifier bridge for charging the firing capacitor C4. Thus, charging current flows from the positive output of the rectifier bridge through capacitor C4, ignition coil SP and, parallel to that path, through diode D9 and choke DR, to the negative output of the rectifier bridge. The high tension voltage $U_C$ is reduced at voltage divider R8, R9, R4 to a value of approximately 2.5 volts, this reduced voltage being compared with the 2.5 volt reference voltage applied to the comparator-connection pin 2 of pulse width modulator PWM. Modulator PWM seeks to control the converter so as to maintain the voltage at its pin 1 at 2.5 volts. With resistor R9 operating as a temperature-sensitive thermistor, the high tension voltage $U_C$ is controlled in response to the temperature sensed by thermistor R9. Thus, and as can be seen in FIG. 2, the high tension voltage changes in inversely proportional relation to the temperature T; the lower the temperature T, the greater the high voltage $U_C$. Thermistor R9 preferably senses the temperature of the apparatus itself, which is dependent upon both the power dissipation abilities of the apparatus and its environment. In a cold apparatus, and with a cold internal combustion engine, a maximum high voltage $U_C$, limited by the Zener diode Z1, is generated, thus automatically supplying the engine with ignition sparks of increased energy for a "cold start" environment. The ignition apparatus is dimensioned and arranged to warm up in conjunction with the engine. In this manner, the engine in its cold condition is supplied with ignition sparks of increased energy and endurance so as to safely ignite even flame-reluctant mixtures. As on the other hand, the engine and, with it, the apparatus approaches its normal operating temperature the high voltage $U_C$ is decreased as ignition sparks of decreased energy and endurance are sufficient to operate the apparatus.

At the same time, thermistor R9 provides overpower protection for the apparatus, increasingly heating up with high power dissipation, thereby decreasing the high voltage $U_C$ and limiting the power consumption of the apparatus. When an ignition pulse, input from the "points" junction wired to the ignition pulse generator, is received at comparators CP3, CP4, a pulse is present at the outputs of these comparators if the ignition pulse exceeds the 5 volt reference voltage. Pulses not representating a genuine ignition pulse, such as those generated by contact bounce, are suppressed by the circuitry of Z2, R19 and C6.

A genuine ignition pulse, however, arriving at the gate electrode of thyristor THY through capacitor C5 and diode D8, triggers the thyristor to a conductive condition. The conductive thyristor discharges the firing capacitor C4 through ignition coil SP, thereby producing a negatively-polarized voltage pulse as shown in FIG. 2.

Following the negatively-polarized initial pulse, a large positively-polarized flyback pulse, of as much as 65 amps, is developed by ignition coil SP. A small portion of the flyback pulse is derived by the interconnected diode D9, choke DR and resistor R16, yielding a small pulse $U_{DR}$ which is limited in amplitude to approximately 40 volts by resistor R16 and in duration to approximately 40 microseconds by choke DR. Using an extremely low-ohmic high performance ignition coil, choke DR should have a value of preferredly 20 uH and a DC-resistance of less than 100 milliohms, and resistor R16 a value of 600 milliohms.

Figure 3:
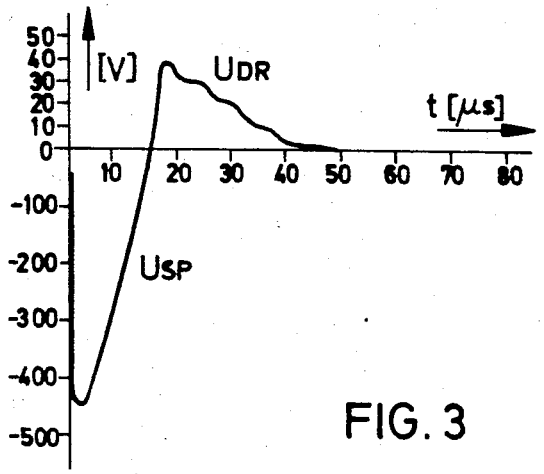
FIG. 3 is a graph of the voltages present at the ignition coil and the choke.

The small pulse $U_{DR}$ (FIG. 3) derived from the flyback pulse acts as a voltage source for its duration, transmitting a short charging-current pulse from the ignition coil connection SP+ through capacitor C4 and thyristor THY. With decay of pulse $U_{DR}$ capacitor C4 feeds the main electrodes of thyristor THY with reversed polarity and reduced voltage accelerating it out of its conductive condition while the main part of the flyback pulse is returned to the ignition coil through diode D9 and the extremely low ohmic DC resistance of choke DR, thus permitting burning of the igition spark to continue without interruption.

As thyristor THY becomes conductive, the voltage $U_G$ present at its gate electrode (FIG. 4) and applied to the inputs of comparators CP1, CP2 varies. The dashed lines in FIG. 4 denote the respective reference voltage levels for the comparators CP1, CP2. The reference voltage of the first comparator CP2 lies above the gate rest-voltage present when the thyristor is blocked or non-conductive, as already biased to 150 mV and seen at the far righthand side of FIG. 4. The reference voltage of the second comparator CP1, on the other hand, lies below that rest-voltage.

Figure 4:
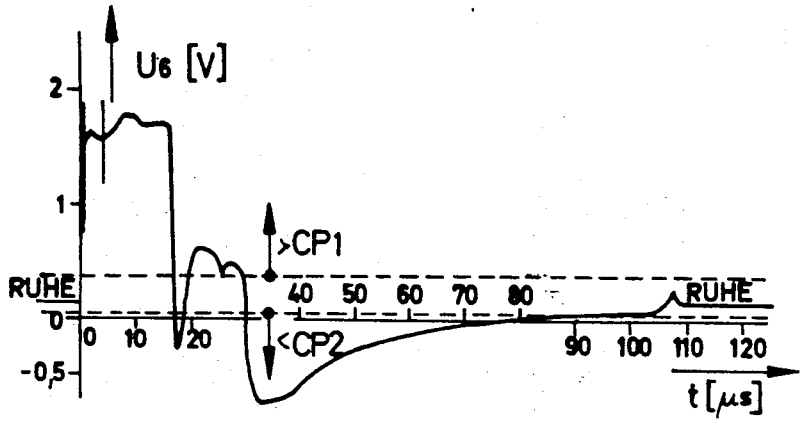
FIG. 4 is a graph of the voltage present at the thyristor gate electrode.

Continuing now to refer to FIG. 4, comparators CP1 and CP2 continue to produce output signals as long as the voltage present at the thyristor gate electrode either exceeds or lies below the comparator reference voltages. Thus, the thyristor is still conductive, or ionized, when the occurring pulse is below the second reference voltage—i.e. the thyristor will fully conduct current again if the power source is immediately switched on. With thyristor THY conductive, the signals output from comparators CP1, CP2 and applied to pin 9 of the pulse width modulator PWM function as a switching-off means, immediately interrupting the modulator and in turn immediately switching off the high voltage source so that no high voltage $U_C$ is generated.

As seen in FIGS. 1 and 4, the rest-voltage present at the gate electrode of the blocked or nonconducting thyristor THY, which is otherwise normally a bit less than 1mV above zero potential, is biased to (for example) 150 mV to enable the second comparator CP1 to compare the thyristor gate electrode potential with a positive reference voltage of, for example, 50 mV. This biasing of the gate electrode greatly facilitates the operation of the apparatus because of the practical inability of comparator CP1 to compare voltages near or below zero potential. Nevertheless, it should again be emphasized that this biasing of the rest voltage at the gate electrode does not influence or alter the normal operating behavior of the thyristor THY.

As can be seen in FIG. 4, approximately 105 microseconds after the firing of capacitor C4 the second comparator CP1 senses an exceeding of the second reference voltage without exceeding the first reference voltage of first comparator CP2. This, however, means that the thyristor is no longer ionized. Following reset or shutdown of the voltage source the thyristor can only be once again switched to its conductive condition if triggered at its gate electrode by a large enough pulse such, for example, as is provided by a genuine ignition pulse. Immediately after thyristor THY is de-ionized, the signal at the compensation pin 9 of pulse width modulator PWM disappears whereby the voltage source is again switched on thus enabling the recharging of firing capacitor C4. The minimized switching-off period of approximately 105 microseconds is also evident in FIG. 2, referring to a maximum voltage of $U_C$. With decreasing voltage $U_C$ the switching-off period is shortened by about 5 microseconds to approximately 100 microseconds at a minimum voltage $U_C$.

With increasing revolutions of the engine the ignition-frequency is also, of course, increasing whereby the recharging periods for firing capacitor C4 become shorter and shorter. This circumstance is also evident in FIG. 2, wherein the high tension voltage $U_C$, supplied to the firing capacitor C4, is seen to decrease in inverse proportion to the ignition frequency.

On the other hand, even with such a shortened charging period for firing capacitor C4 its correspondingly decreased voltage charge remains sufficient to safely and effectively ignite the engine fuel mixture, at the highest revolutions of the engine and the accompanying reduced stay of the pistons at top dead center. Through monitoring of the voltage present at the thyristor gate electrode and the accelerated de-ionization, or blocking, of the thyristor, the switching-off period of the voltage source is kept as short as possible so as to maximize the time remaining to recharge the firing capacitor.

By the use of comparators for monitoring the thyristor gate voltage, and through derivation from the flyback pulse of the small positive pulse $U_{DR}$ which, after its decay, effects a change in the polarity of the voltage $U_{A,THY}$ (FIG. 5) applied to the anode-cathode path of the thyristor thus acceleratedly deionizing or blocking it, a maximum ignition frequency of beyond 1 kHz can be realized. It should be pointed out that 800 Hz, in an eight-cylinder four-stroke engine, corresponds to an engine speed of 12,000 revs/minute. In addition, using a modern, commercial high performance ignition coil as an ignition-transformer, with a maximum voltage $U_C$, an effective spark burning period of 350 microseconds can be achieved. And, applying different, higher-ohmic ignition coils, with a less steep rise of voltage $U_{SP}$ (FIG. 3), an effective spark-burning period of 600 to 700 ms can be realized.

Figure 5:
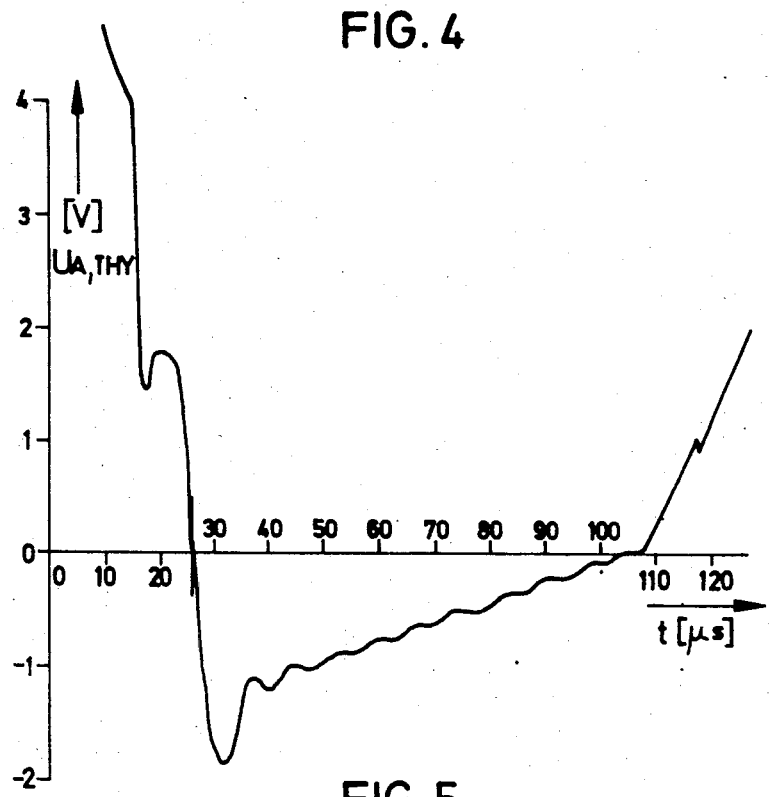
FIG. 5 is a graph of the voltage present between the anode and the cathode of the thyristor.

FIGS. 4 and 5, which respectively depict the voltage $U_G$ present at the gate electrode of the thyristor and the voltage $U_{A,THY}$ measured at the thyristor anode-cathode path, very effectively illustrate the correlation of time and amplitude of these two voltages. FIG. 5 shows the relatively steep voltage drop which occurs at the start of thyristor conduction; at the same time, the voltage $U_G$ present at the gate electrode is dropping steeply beyond zero potential. However, when the thyristor receives the small pulse derived from the flyback pulse, the voltage at the thyristor anode-cathode path once again minimally and temporarily increases, and thereafter continues the accelerated de-ionization, or blocking, of the thyristor. At the same time, the voltage $U_G$ appearing at the gate electrode is dropping below zero potential, the voltage $U_G$ then proceeding to decay to the gate rest-voltage as shown in FIG. 4. As previously noted, this rest-voltage is achieved after a period of approximately 110 microseconds. And, when the combined signal from the outputs of comparators Cp1 and CP2 disappears, the pulse width modulator PWM and with it the electrical power source can again be switched on or actuated.

Thus, and as should be apparent from an examination of FIGS. 4 and 5, the voltage present at the thyristor gate electrode accurately and continuously reflects the actual operating condition of the thyristor.

It should also be understood that although the embodiment of the invention schematically shown in FIG. 1 and heretofore described employs a pair of comparators CP3, CP4 for triggering the thyristor, a single comparator may alternatively be used for the same purpose. The use of two comparators, however, strengthens the triggering pulse, distributes the load on the output stage transistors of the two comparators, and is readily implemented utilizing commercially available fourfold comparator integrated circuit components which can therefore contain all of the comparators CP1, CP2, CP3 and CP4 in a single circuit package.

What I claim as my invention is:

1. In a high voltage capacitor-discharge ignition apparatus for internal combustion engines and including an interruptable source of electrical power comprising a pulse width modulator controlled low-to-high voltage DC-DC converter operable as a blocking oscillator in the audio frequency range, a firing capacitor for receiving a high voltage charge from said electrical power source, and a thyristor triggerable by ignition pulses at its gate electrode to change from a nonconductive to a conductive condition for discharging said firing capacitor into an ignition coil having a primary winding and which generates a flyback pulse, said thyristor being returned to said nonconductive condition by interrupting the operation of said electrical power source, the improvement comprising:

at least a first comparator connected to the gate electrode of said thyristor for directly and continuously monitoring the voltage at said gate electrode as an indicator of the operating condition of the thyristor, for comparing said gate electrode voltage with at least a first predetermined reference voltage, and for generating an output signal based upon said comparison to interrupt the operation of said power source only so long as said thyristor is in said conductive condition; and a circuit connected to the primary winding of the ignition coil for deriving an electrical pulse from the flyback pulse and accelerating the change of said thyristor from said conductive to said nonconductive condition.

2. In a capacitor discharge ignition apparatus in accordance with claim 1, wherein said circuit shunts the primary winding of the ignition coil and comprises a diode in series connection with the parallel-connected combination of a resistor and a choke.

3. In a capacitor-discharge ignition apparatus in accordance with claim 1, said predetermined reference voltage being greater than the gate electrode rest potential of said thyristor in said nonconductive condition, and said comparator always generating said output signal for interrupting the operation of said power source when the gate electrode rest potential exceeds said reference voltage.

4. In a capacitor-discharge ignition apparatus in accordance with claim 1, the improvement further comprising a second comparator connected to the thyristor gate electrode, and a second predetermined reference voltage associated with and input to said second comparator for direct and continuous comparison with the voltage at the thyristor gate electrode, said second reference voltage being less than the gate electrode rest potential of said thyristor in said nonconductive condition, and said second comparator always generating said output signal for interrupting the operation of said power source when the gate electrode rest potential is less than the second reference voltage.

5. In a capacitor-discharge ignition apparatus in accordance with claim 4, the improvement further comprising a second comparator connected to the thyristor gate electrode, and a second predetermined reference voltage associated with and input to said second comparator for direct and continuous comparison with the voltage at the thyristor gate electrode, said second reference voltage being less than the gate electrode rest potential of said thyristor in said nonconductive condition, and said second comparator always generating said output signal for interrupting the operation of said power source when the gate electrode rest potential is less than the second reference voltage.

6. In a capacitor-discharge ignition apparatus in accordance with claim 4, wherein said power supply generates a positive voltage with respect to ground, further comprising a biasing resistor connecting said thyristor gate electrode to a supplemental reference voltage for minimally raising the gate electrode rest potential to a predetermined level for enabling said second comparator to sense undershooting of the gate electrode rest potential, said predetermined level preferably being approximately 150 millivolts.

7. In a capacitor-discharge ignition apparatus in accordance with claim 5, wherein said power supply generates a positive voltage with respect to ground, further comprising a biasing resistor connecting said thyristor gate electrode to a supplemental reference voltage for minimally raising the gate electrode rest potential to a predetermined level for enabling said second comparator to sense undershooting of the gate electrode rest potential, said predetermined level preferably being approximately 150 millivolts.

8. In a capacitor-discharge ignition apparatus in accordance with claim 1, further comprising at least a supplemental comparator for receiving the ignition pulses at a first input and a supplemental predetermined reference voltage at a second input, and having an output connected to said thyristor gate electrode for triggering said thyristor to change from said nonconductive to said conductive condition upon receipt of an ignition pulse.

9. In a capacitor-discharge ignition apparatus in accordance with claim 8, further comprising a series-connected resistor and diode through which the ignition pulses are directed to said supplemental comparator first input, one end of said resistor being connected to ground, and a zener diode connected between the other end of said resistor and ground, for suppressing unwanted ignition noise.

10. In a capacitor-discharge ignition apparatus in accordance with claim 1, wherein said pulse width modulator operatively limits and stabilizes the high voltage for charging said firing capacitor in accordance with temperature.

11. In a capacitor-discharge ignition apparatus in accordance with claim 10, said pulse width modulator having a comparator input connected to the high voltage generated by the convertor through a thermistor for limiting and stabilizing the high voltage in accordance with temperature.

12. In a capacitor-discharge ignition apparatus in accordance with claim 11, wherein said thermistor in operating to limit and stabilize the high voltage in accordance with temperature uses the temperature of the capacitor-discharge ignition apparatus as a reference.

13. In a capacitor-discharge ignition apparatus in accordance with claim 12, wherein said thermistor operatively provides thermal overboost protection for the apparatus.

14. In a capacitor-discharge ignition apparatus in accordance with claim 11, further comprising a zener diode connected in parallel with said thermistor for limiting the high voltage to a predetermined peak value.

* * * * *